US007866406B2

(12) United States Patent
Mackenzie

(10) Patent No.: US 7,866,406 B2
(45) Date of Patent: Jan. 11, 2011

(54) SYSTEM AND METHOD FOR PLUGGING A DOWNHOLE WELLBORE

(75) Inventor: Gordon R. Mackenzie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 107 days.

(21) Appl. No.: 12/235,272

(22) Filed: Sep. 22, 2008

(65) Prior Publication Data

US 2010/0071912 A1 Mar. 25, 2010

(51) Int. Cl.
*E21B 33/12* (2006.01)

(52) U.S. Cl. ..... 166/382; 166/387; 166/134; 166/181

(58) Field of Classification Search ..... 166/382, 166/387, 123, 134, 181
See application file for complete search history.

(56) References Cited

U.S. PATENT DOCUMENTS

| | | | |
|---|---|---|---|
| 5,044,602 | A | 9/1991 | Heinonen |
| 5,821,452 | A | 10/1998 | Neuroth et al. |
| 6,659,178 | B2 | 12/2003 | Wilson et al. |
| 6,918,441 | B2 | 7/2005 | Dallas |
| 7,143,832 | B2 | 12/2006 | Freyer |
| 7,387,158 | B2 | 6/2008 | Murray et al. |
| 7,422,071 | B2 | 9/2008 | Wilkie et al. |
| 2003/0146003 | A1 | 8/2003 | Duggan et al. |
| 2004/0055758 | A1 | 3/2004 | Brezinski et al. |
| 2004/0112609 | A1 | 6/2004 | Whanger et al. |
| 2004/0261990 | A1 | 12/2004 | Bosma et al. |
| 2006/0086501 | A1 | 4/2006 | Creel et al. |
| 2007/0056735 | A1 | 3/2007 | Bosma et al. |
| 2008/0017376 | A1 | 1/2008 | Badalamenti et al. |
| 2008/0125335 | A1 | 5/2008 | Bhavsar |
| 2008/0135260 | A1 | 6/2008 | Berzin et al. |
| 2008/0149351 | A1 | 6/2008 | Marya et al. |
| 2009/0131563 | A1 * | 5/2009 | Wang et al. ..... 524/96 |
| 2009/0294118 | A1 * | 12/2009 | Clemens ..... 166/89.1 |

FOREIGN PATENT DOCUMENTS

| | | |
|---|---|---|
| CA | 2 435 382 | 8/2002 |
| CA | 2 452 798 | 9/2006 |
| GB | 2 393 467 | 3/2004 |
| GB | 2 422 166 | 7/2006 |
| WO | 2008/008687 | 1/2008 |

OTHER PUBLICATIONS

"Swellpacker Isolation System: Achieve Complete Zonal Isolation of Producing Zones," H04810, Easywell, Halliburton Aug. 2008, Retrieved online on Sep. 9, 2008 from: http://www.halliburton.com/public/cps/contents/Data_Sheets/web/H/H04810.pdf.

(Continued)

*Primary Examiner*—William P Neuder
(74) *Attorney, Agent, or Firm*—Cantor Colburn LLP

(57) ABSTRACT

A method for plugging a downhole wellbore including, running an anchor and swellable seal disposed at a mandrel within the downhole wellbore, setting the anchor within the downhole wellbore, releasing the anchor and the swellable seal, and swelling the swellable seal into contact with another downhole structure.

15 Claims, 1 Drawing Sheet

OTHER PUBLICATIONS

"Swellpacker Cable System: Swellpacker System for Spliceless Feed-Through," H04995, Easywell, Halliburton, Aug. 2008, Retrieved online on Sep. 9, 2008 from: http://www.halliburton.com/public/cps/contents/Data_Sheets/web/H/H04995.pdf.

Swellpacker HP System: Swellpacker System for High Pressure,: H04994, Easywell, Halliburton, Aug. 2008, Retrieved online on Sep. 9, 2008 from: http://www.halliburton.com/public/cps/contents/Data_Sheets/web/H/H04994.pdf.

"B-Zip: External Zonal Inflow Profiler," Swellfix Zonal Isolation, Copyright 2008, Retrieved online on Sep. 9, 2008 from: http://www.swellfix.net/docs/B-ZIP.pdf.

"TAM FREECAP Swellable Packers," Tam International, Copyright 2007, Retrieved online on Sep. 9, 2008 from: http://www.tamintl.com/images/stories/pdfs/FREECAP_Brochure.pdf.

Hertfelder, G., et al. "Are Swelling-Elastomer Technology, Preperforated Liner; and Intelligent-Well Technology Suitable Alternatives to Conventional Completion Architecture?" SPE/IADC Drilling Conference, Amsterdam, The Netherlands, Feb. 20-22, 2007. Paper No. 105443-MS.

Keshka, A., et al. Practical Uses of Swellable Packer Technology to Reduce Water Cut: Case Studies from the Middle East and Other Areas, Aberdeen, Scotland, U.K. Sep. 4-7, 2007. Paper No. 108613-MS.

Rogers, H., et al. New Equipments Designs Enable Swellable Technology in Cementless COmpletions, IADC/SPE Drilling COnference, Mar. 4-6, 2008, Orlando, Florida, USA. Paper No. 112302-MS.

Vargus, G., et al. Completion System Allows for Interventionless Stimulation Treatments in Horizontal Wells with Multiple Shale Pay Zones, SPE Annual Technical Conference and Exhibition, Denver, Colorado, Sep. 21-24, 2008. Paper No. SPE-115476-MS.

Welling, R., et al. "Inflow Profile Control in Horizontal Wells in a Fractured Carbonate Using Swellable Elastomers," SPE Middle East Oil and Gas Show and Conference, Kingdom of Bahrain, Mar. 11-14, 2007. Paper No. 105709.

* cited by examiner

SYSTEM AND METHOD FOR PLUGGING A DOWNHOLE WELLBORE

BACKGROUND

Well operators in the hydrocarbon recovery industry often seal tubulars to downhole wellbores such as casings and liners. Several systems exist for sealing the tubulars to the downhole wellbores and many function adequately. Most of these systems, however, include complex actuation devices. For example, many systems axially compress an elastomeric sleeve causing it to expand radially into sealing engagement with the downhole wellbore. This axial compression includes valves, pistons and actuators each having multiple moving parts and sliding seals that have potential failure modes associated therewith. Such systems are complex, costly and difficult to effectively deploy. Accordingly, the industry is receptive to simple, cost effective systems for plugging a downhole wellbore.

BRIEF DESCRIPTION

Disclosed herein is a method for plugging a downhole wellbore. The method includes, running an anchor and swellable seal disposed at a mandrel within the downhole wellbore, setting the anchor within the downhole wellbore, releasing the anchor and the swellable seal, and swelling the swellable seal into contact with another downhole structure.

Further disclosed herein is a downhole wellbore plugging system. The system includes, a mandrel that is runnable within a downhole wellbore and releasable therewithin, an anchor disposed at the mandrel being anchorable to the downhole wellbore, and a swellable seal disposed at the mandrel being sealable with the downhole wellbore and the mandrel.

Further disclosed herein is a method for plugging a downhole wellbore. The method includes, running a tool having an anchor and a swellable seal into the downhole wellbore with a wireline, anchoring the tool within the downhole wellbore, retrieving the wireline, and swelling the swellable seal into contact with another downhole structure subsequent to retrieval of the wireline.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
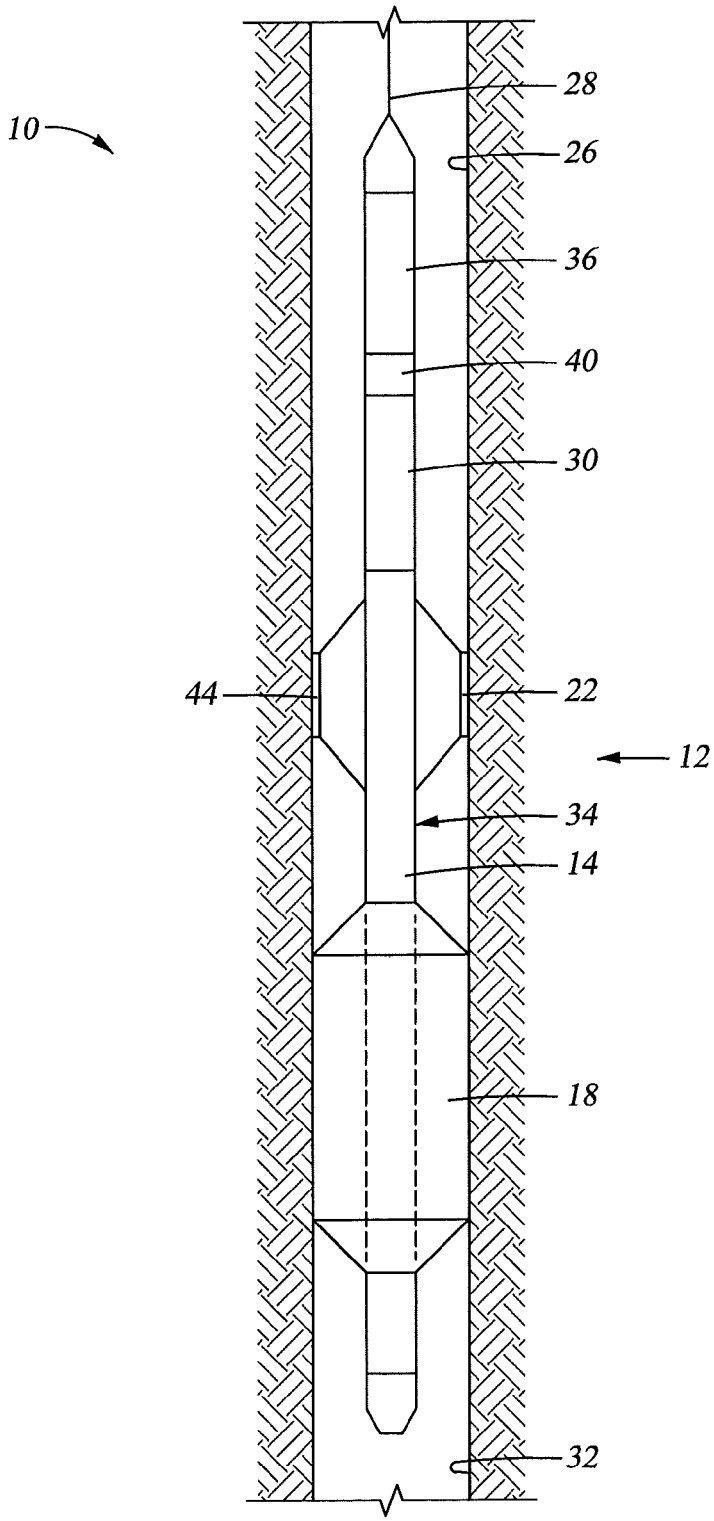
FIG. 1 depicts a schematic view of a wellbore plugging system according to an embodiment disclosed herein.

A detailed description of one or more embodiments of the disclosed apparatus and method are presented herein by way of exemplification and not limitation with reference to the FIGURE.

Referring to FIG. 1, an embodiment of a wellbore plugging system disclosed herein is illustrated generally at 10. The system 10, among other things includes a downhole tool 12 having, a mandrel 14 with a swellable seal 18 and an anchor 22 mounted thereat. The tool 12 is positionable downhole within a wellbore 26 by a wireline 28 that is disconnectable from the mandrel 14 by a disconnectable connector 30. The swellable seal 18 can be made of a variety of materials that swell when exposed to certain well fluids, such as hydrocarbons and water, for example. Additionally, the swellable seal 18 can swell in response to exposure to certain conditions that are commonly encountered in downhole environments, such as, high temperatures and high pressures as well as exposure to certain chemicals. The swellable seal 18, can forcibly contact structures it comes in contact with in response to the increase in volume that occurs during swelling. Such contactable structures include walls 32 of the wellbore 26, which may be a casing, liner or other tubular member, or open hole, or an outer surface 34 of the mandrel 14, for example. These contact forces are sufficient to create a seal between the swellable seal 18 and the outer surface 34 as well as between the swellable seal 18 and the walls 32. The swellable seal 18 can also be sealed to the mandrel 14 based on the original construction such that swelling of the swellable seal 18 is not needed to form the seal with the outer surface 34. A duration of time needed from initiation of swelling to formation of a seal is dependent upon various factors, some of which will be reviewed below.

The swell rate, or the rate of increase in volume, of the swellable seal 18, can vary depending upon a variety of parameters. For example, the chemical make up of both the swellable seal 18 itself and the well fluid into which the swellable seal 18 is submerged, can greatly affect the swell rate. Additionally, clearance dimensions between the swellable seal 18 and the surfaces 32, 34 as well as the dimensions of the swellable seal 18 itself will also affect the time required to form a seal. Typically, the greater the clearance the longer the duration before a seal is formed. A designer can, therefore, use these parameters to set a desired time duration from initiation of swelling to initiation of sealing. Delay in swelling to the point of sealing may be desirable to allow time for an operator to run the tool 12 into the desired position downhole prior to forming a seal with the walls 32, for example. Such delays may be set from just a few hours to several days or more.

In embodiments of the invention, an operator will set the anchor 22 prior to forming the seal. The anchor 22 has slips 44 that are deployable and engagable with the walls 32 of the wellbore 26 to fixedly attach the system 10 to the wellbore 26. Although the system disclosed herein has the anchor 22 positioned above the swellable seal 18, along the mandrel 14, alternate embodiments could just as well have the anchor 22 positioned below the swellable seal 18. Regardless of the relative positions of the anchor 22 with the swellable seal 18, initiation to actuate the setting of the anchor 22 can be carried out in various ways.

For example, setting of the anchor 22 can be initiated, and optionally actuated, from surface via the wireline 28. The wireline 28 can be used to initiate a trigger 36 that actuates an actuator 40, or the wireline 28 can be used to actuate the actuator 40 directly. For example, in embodiments wherein the wireline 28 is an electric wireline 28 an electrical signal could be transmitted along the wireline 28 and used to open a valve (the trigger 36) that permits downhole fluid under hydrostatic pressure access to a chamber containing a piston and a compressible gas at atmospheric pressure, to thereby move the piston (the actuator 40) to set the anchor 22. In an alternate embodiment, the electrical transmission can be used to energize a motor (the trigger 36) that drives a pump (the actuator 40) to hydraulically set the anchor 22. Still other embodiments, of the system 10, could employ timing devices (the trigger 36), or other means, that initiate actuation in response to exposure to a specific downhole parameter, such as, elevated pressure, elevated temperature and chemical exposure, for example.

Regardless of the trigger 36 and the actuator 40 employed to set the anchor 22, the anchor 22 should be set prior to setting of the swellable seal 18. In embodiments wherein the swellable seal 18 begins swelling as soon as it is exposed to certain downhole conditions, the duration to set the swellable seal 18 needs to be longer than the time it will take to run the tool 12 to the desired depth. This will prevent rubbing damage due to excess friction between the swellable seal 18 and the walls 32 while the tool 12 is being run. Once the tool 12 is in position the swelling of the swellable seal 18 can continue until a seal is formed.

Optionally, an operator is free to disconnect the wireline 28 from the tool 12, at the disconnectable connector 30, once the anchor 22 is set, even if the swellable seal 18 has not yet sealingly engaged the walls 32. As such, a swellable seal 18 that takes several days to fully swell and seal with the walls 32 may be a desirable condition to assure that the operator has adequate time to fully run the tool 12 to the desired depth. It may be advantageous to position the disconnectable connector 30 between the actuator 40 and the anchor 22 to thereby allow an operator to remove the trigger 36 and the actuator 40 with the wireline 28 thereby minimizing a portion of the tool 12 that remains downhole.

The foregoing embodiments allow a well operator to quickly and inexpensively run the tool 12 with the wireline 28 to a position within the wellbore 26, set the anchor 22 and then retrieve the wireline 28 and then wait for the swellable seal 18 to permanently plug off the wellbore 26. Since it is not uncommon for wells to water out from the bottom up, several of the tools 12 could be used in a single well to sequentially plug off zones from the bottom up as they begin producing water.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method for plugging a downhole wellbore, comprising:

running an anchor and swellable seal disposed at a mandrel within the downhole wellbore;

setting the anchor within the downhole wellbore;

releasing the anchor and the swellable seal;

swelling the swellable seal into contact with another downhole structure; and plugging the downhole wellbore to flow therethrough past the swellable seal.

2. The method for plugging a downhole wellbore of claim 1, wherein the releasing is disconnecting the anchor and the swellable seal from a wireline.

3. The method for plugging a downhole wellbore of claim 1, wherein the releasing occurs prior to the swelling into contact with the downhole structure.

4. The method for plugging a downhole wellbore of claim 1, wherein the swelling further includes sealing the swellable seal to the downhole structure.

5. The method for plugging a downhole wellbore of claim 4, further comprising initiating swelling of the swellable seal with one of a change in pressure, a change in temperature, a change in time and exposure to a chemical.

6. The method for plugging a downhole wellbore of claim 4, wherein the swelling of the swellable seal is in response to exposure of the swellable seal to a fluid.

7. The method for plugging a downhole wellbore of claim 6, wherein the fluid is at least one of, oil, water, hydrocarbon and a gas.

8. The method for plugging a downhole wellbore of claim 1, wherein the swelling of the swellable seal into contact with the downhole structure is delayed more than twenty-four hours from initiation of swelling of the swellable seal.

9. The method for plugging a downhole wellbore of claim 1, further comprising initiating setting of the anchor with one of time lapse, a change in pressure, a change in temperature and exposure to a chemical.

10. The method for plugging a downhole wellbore of claim 1, further comprising triggering a setting tool to set the anchor.

11. The method for plugging a downhole wellbore of claim 10, wherein the triggering is initiated at surface.

12. The method for plugging a downhole wellbore of claim 10, wherein the triggering employs a wireline.

13. The method for plugging a downhole wellbore of claim 12, wherein the wireline is electrically conductive.

14. A downhole wellbore plugging system, comprising:

a mandrel being runnable within a downhole wellbore and releasable therewithin;

an anchor disposed at the mandrel being anchorable to the downhole wellbore; and a swellable seal disposed at the mandrel being sealable with the downhole wellbore and the mandrel in response to swelling thereof to thereby plug the downhole wellbore to fluid flow therethrough.

15. A method for plugging a downhole wellbore comprising:

running a tool having an anchor and a swellable seal into the downhole wellbore with a wireline;

anchoring the tool within the downhole wellbore;

retrieving the wireline; and swelling the swellable seal into contact with another downhole structure subsequent to retrieval of the wireline thereby plugging the downhole wellbore to fluid flow past the swellable seal.

* * * * *